United States Patent [19]

Mark

[11] 4,308,567

[45] Dec. 29, 1981

[54] LIGHTING CONTROL INTERFACE APPARATUS

[75] Inventor: James S. Mark, Peterborough, Canada

[73] Assignee: Canadian General Electric Company Limited, Canada

[21] Appl. No.: 123,241

[22] Filed: Feb. 21, 1980

[30] Foreign Application Priority Data

Oct. 4, 1979 [CA] Canada ..... 336996

[51] Int. Cl.[3] ..... H01H 47/32

[52] U.S. Cl. ..... 361/187; 361/167; 307/362; 307/132 E

[58] Field of Search ..... 361/167, 186, 187, 193, 361/194; 307/130, 132 E, 350, 358, 362, 247 R

[56] References Cited

U.S. PATENT DOCUMENTS

| | | | |
|---|---|---|---|
| 3,812,382 | 5/1974 | Pascente | 361/167 |
| 3,829,683 | 8/1974 | Long et al. | 361/167 |
| 3,938,010 | 2/1976 | Long et al. | 361/167 |
| 4,188,547 | 2/1980 | Fox | 307/362 |

*Primary Examiner*—J. D. Miller
*Assistant Examiner*—L. C. Schroeder
*Attorney, Agent, or Firm*—Peter E. Rochford; Walter C. Bernkopf

[57] ABSTRACT

An interface apparatus, for remotely controlling a plurality of solenoid actuated switching relays having first and second energizing coils, is capable of providing momentary first and second electrical signals respectively in response to an interruption of an input signal to the apparatus and the initiation of the input signal. The interface apparatus includes a first comparator sensing a change in the input signal, a second comparator sensing a change in the output of the first comparator so as to maintain the second comparator output 180 degrees out of phase with the first comparator output, and first and second monostable multivibrators that each have a trigger input connected to the output of a corresponding comparator so as to generate a momentary electrical signal when the trigger input senses a negative excursion in a change of state at the output of the corresponding comparator. The present interface apparatus has a considerably simplified circuit arrangement which has brought about a considerable cost reduction in the apparatus in addition to an improvement in serviceability therefor.

10 Claims, 3 Drawing Figures

LIGHTING CONTROL INTERFACE APPARATUS

This invention relates to a remote control switching system and, in particular, to an interface apparatus that remotely controls pulse actuated switching relays.

Pulse activated, mechanically held relays are increasingly being used in conjunction with various automatic control devices to program electrical circuits on and off. However, many of these automatic control devices have a continuous output signal, rather than a pulse output. It has been a problem to use the automatic control devices with pulse actuated relays, especially when local and master override switches are also required, so that these relays are not continuously energized which could cause thermal problems and possibly mechanical binding in the relays.

One particular interface apparatus device that provides momentary pulses to activate pulse actuated solenoid relays is disclosed in Canadian patent application Ser. No. 279,739 filed June 2, 1977 in the name of W. L. Ferrigno. The interface apparatus decodes any change in a continuous input signal and then encodes these changes into either a first or a second momentary electrical signal that is utilized to control the energization of a respective first or second coil of each relay.

A disadvantage with the above-mentioned interface apparatus is that the apparatus is essentially comprised of numerous discrete electrical components that are not readily accessible for servicing and, in combination, are expensive to manufacture. More particularly, the interface apparatus itself can not be replaced if it malfunctions and thus a considerable amount of rewiring of the remote control switching system is usually required.

Another disadvantage with this interface apparatus is that should the decoder fail to sense changes in the continuous input signal then the apparatus has no overriding provision to energize either the first or second coil of each relay in the switching system. Furthermore, if such an override provision were to be made, it too would have to provide only a momentary electrical signal to the coils because a continuous signal could result in thermal problems and possibly mechanical binding of the relays.

It is therefore a general object of the present invention to provide an interface apparatus that is an improvement on the above mentioned interface apparatus and is not subject to the above noted problems and disadvantages.

Briefly, the present invention relates to a remote control switching system having an interface apparatus capable of producing momentary first and second electrical signals to control energization of first and second coils of solenoid actuated relays respectively in response to interruption and initiation of an input signal to the apparatus. The interface apparatus includes first and second comparing means and first and second pulse generation means. The first comparing means senses changes in the input signal. The second comparing means senses changes in the output of the first comparing means. The first pulse generation means generates the first momentary electrical signal when the output of the first comparing means changes in response to the initiation of the input signal. The second pulse generation means generates the second momentary electrical signal when the output of the second comparing means changes in response to the interruption of the input signal. The significance of the interface apparatus is that it has a simplified circuit that can be made for about a third of the cost of the previously mentioned interface apparatus. Furthermore, the novel simplified circuitry is readily adapted for insertion into and removal from the switching system without affecting the remaining portion of the system.

Additionally, an override device may be provided to each pulse generation means which would involve grounding an input to the pulse generation means. This is a significant feature because the override device would only initiate one momentary electrical signal.

In accordance with one aspect of the invention there is provided in a remote control switching system an interface apparatus capable of producing momentary first and second electrical signals to control energization of first and second coils of solenoid actuated relays respectively in response to interruption and initiation of an input signal present at an input for the apparatus, the apparatus comprising: a first comparing means having a sensing input operably connected to the apparatus input to sense changes in the input signal by comparing the input signal with a first reference voltage value, the first comparing means having a first output whose voltage value changes from its first to its second level when the input signal becomes less than the first reference value and changes from its second to its first level when the input signal becomes greater than the first reference value; a second comparing means having a sensing input operably connected to the first output to sense changes in the first output voltage value by comparing the first output value with a second reference voltage value, the second comparing means having a second output whose voltage value changes from its first to its second level when the first output voltage value changes to its first level becoming less than the second reference value and changes from its second to its first level when the first output voltage value changes to its second level becoming greater than the second reference value; a first pulse generator means connected to the first output to provide the momentary first electrical signal to the first coils when the first output voltage value changes from its second to its first level; and, a second pulse generation means connected to the second output to provide the momentary second electrical signal to the second coils when the second output voltage value changes from its first to its second level.

For a better understanding of the nature and objects of the invention reference may be had by way of example, to the accompanying diagrammatic drawings in which.

Figure 1:
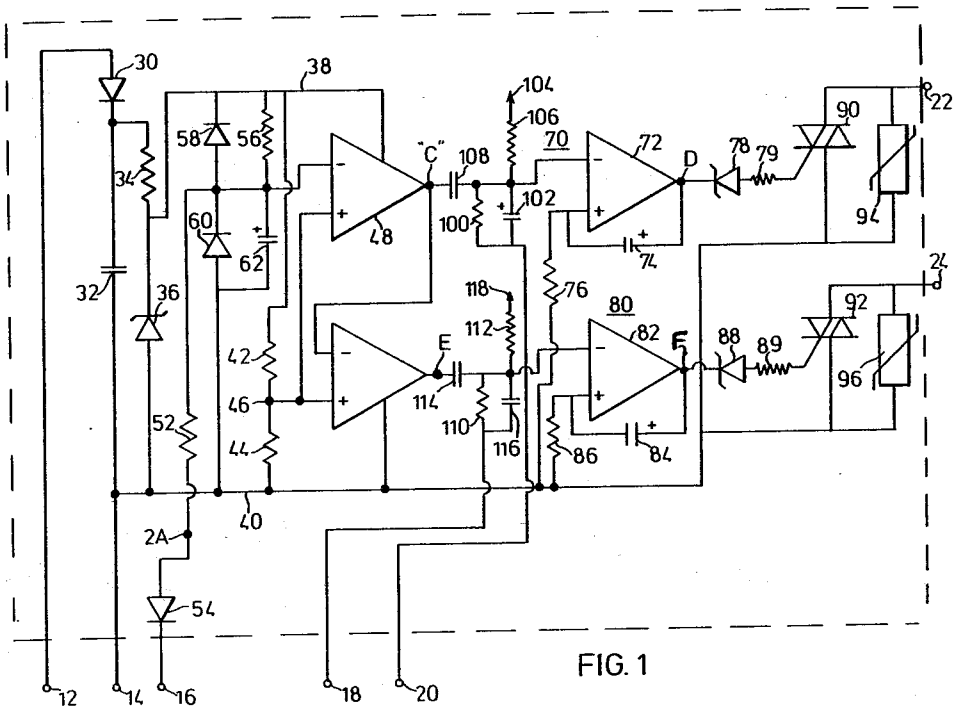
FIG. 1 is a circuit diagram for the interface apparatus of the present invention.

Referring now to FIG. 1, interface apparatus or interface 10 is shown having input terminals 12, 14, 16, 18 and 20, and output terminals 22 and 24. Interface 10 may be utilized to control the energization of pulse actuated relays of a remote control wiring system such as the system disclosed in Canadian patent application Ser. No. 322,184—filed Feb. 23, 1979 and assigned to the assignee of the instant application. The pulse actuated relays disclosed therein each have a first solenoid coil that when energized moves a solenoid plunger of the relay into a first position. The relays also have a second coil that when energized moves the solenoid plunger into a second position. The plunger only moves when a coil is energized.

Terminal 12 is connected in circuit with the secondary winding of a step down transformer (not shown) for the wiring system. The a.c. supply from the transformer introduced at terminal 12 is rectified by diode 30, filtered by capacitor 32 and regulated by resistor 34 and zener diode 36 to provide a predetermined regulated d.c. supply on supply bus 38. Terminal 14 is grounded to provide a common ground bus 40 for the interface 10.

Resistors 42 and 44, connected in series between bus 38 and bus 40, provide a voltage divider circuit that determines a reference voltage at point 46. Preferrably, resistors 42 and 44 are equal in value so that the reference voltage at point 46 is half the value of the voltage on d.c. bus 38. The reference voltage value at point 46 in supplied to the non-inverting input terminal or reference input terminal of first comparing means 48 and second comparing means 50. It should be understood that two voltage divider circuits may be employed should it be desired that the reference voltage values supplied to each of the comparing means be unequal. In FIG. 1, the comparing means are shown as operational amplifiers connected as comparators.

The sensing input or inverting input terminal of the first comparator 48 is capable of sensing a change in the voltage value at point B. Point B is connected in circuit with input terminal 16. The input signal to the interface device 10 is provided on terminal 16. The input signal on terminal 16 is interrupted by closing a contact switch (not shown) associated with interface 10 which acts to connect terminal 16 with terminal 14 thereby grounding terminal 16. Grounding terminal 16 in this manner permits current to flow from point B through resistor 52 and diode 54, otherwise, terminal 16 is open circuited and current does not flow from point B through resistor 52. Diode 54 is provided to prevent any positive spikes or impulses from influencing the voltage at point B. When terminal 16 is open, i.e. the switch is normally open, resistor 56 holds the voltage at point B high. Resistor 52, diodes 58, 60 and capacitor 62 provide a filtering and clamping action for the input signal introduced by terminal 16.

Figure 2:
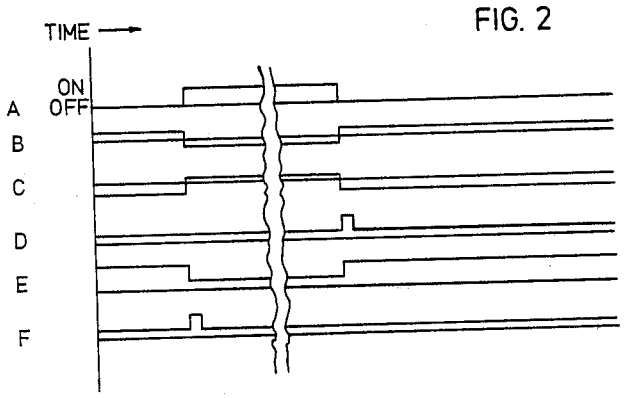
FIG. 2 is a timing diagram for the circuit shown in FIG. 1.

Referring to FIGS. 1 and 2, it is seen that when the relay switches are OFF, as represented by curve A, the voltage at point B is high. In this instance, the value of voltage at point B is greater than the reference voltage supplied to the non-inverting terminal of the first comparator 48. Comparator 48 has a first and second level of output voltage and when the voltage at point B exceeds the reference voltage the result is that the output voltage of comparator 48 is in its lower first level (see FIG. 2 curve C).

The second comparator 50 senses changes in the output of comparator 48 because the inverting or sensing input of comparator 50 is connected in series with the output of comparator 48. Because comparators 48, 50 operate in the same manner the output voltage of comparator 50 at point E is always out of phase with the output voltage of comparator 48 at point C. Thus, when the voltage output of comparator 48 is in its lower first level the voltage output of comparator 50 is in its upper second level, and when the voltage output of comparator 48 is in its upper second level the voltage output of comparator 50 is in its lower first level (compare curves C and E of FIG. 2). The voltage level of the comparator 50 may be said to be the inverse of the voltage level of the comparator 48.

A first pulse generation means 70 includes a first monostable multivibrator 72 having its trigger or inverting input connected in series with the output of the first comparator 48. The multivibrator 72 generates a first momentary electrical signal or first pulse in response to the output of comparator 48 changing from its second level to its first level ie: a negative pulse or excursion. The monostable multivibrator 72 is a single-ended operational amplifier whose output will switch from ground potential to a first positive output voltage value when the inverting input lowers to a first predetermined positive voltage value, with the positive input at ground potential. Thus the output of multivibrator 72 in its normal quiescent condition is held at ground because resistor 106 holds the inverting input voltage to the first predetermined positive voltage value less than the supply voltage at 104. When a negative pulse change from second to first level is received from the output of comparator 48, or when the RC combination of resistor 100 and capacitor 102 is grounded, the voltage at the inverting input of multivibrator 72 decreases to ground or below. The output of multivibrator 72 is coupled through capacitor 74 raising the positive input to a positive voltage value which latches multivibrator 72 into an on condition. The condition continues until the positive input voltage value decreases to that of the negative input, at which time multivibrator 72 returns to its quiescent condition. The time constant of multivibrator 72 is determined by capacitor 74 and resistor 46. The original pulse amplitude is determined by the load on multivibrator 72, which consists of zener 78, resistor 79 and the internal gate resistance of triac 30.

Similarly, a second pulse generation means 80 includes a second monostable multivibrator 82 having its inverting input connected in series with the output of the second comparator 50. The multivibrator 82 generates a momentary first electrical signal or pulse in response to the output of comparator 50 changing from its second level to its first level i.e. a negative pulse on excursion. The duration of the pulse for multivibrator 82 is determined by an RC network, which is connected from the output to the non-inverting input of multivibrator 82. The RC network is shown to include capacitor 84 and resistor 86. Resistor 89, zener 88 and triac 92 act in the same manner with respect to multivibrator 82 as do resistor 79, zener 78 and triac 90 with respect to multivibrator 72.

Resistors 79 and 89 also limit gate current to respective triacs 90, 92, while zeners 78, 88 each eliminate the D.C. voltage occurring at the output of respective multivibrators 72, 82 because the multivibrators will not clamp the ground bus 40. Varistors 94, 96 are respectively connected across triacs 90, 92 to eliminate transients that might trigger the triacs. It should be understood that other means, such as a diode connected in parallel with a series combination of a resistor and capacitor, may be substituted for the varistors.

The interface 10 is also provided with override devices to energize a selected coil of the relays. The coil of each relay that is energized by output terminal 22 is associated with input override terminal 20. Terminal 20 is connected to a contact switch (not shown) that is normally open, but when closed connects the terminal to ground. Terminal 20 is connected through the parallel combination of resistor 100 and capacitor 102 to the inverting or triggering input of multivibrator 72. The override device functions by grounding the trigger input. Recall, the upper second level of the output voltage from comparator 48 is held above ground potential by voltage supply 104 and resistor 106. Capacitor 108 isolates comparator 48.

Similarily, input override terminal 18 is provided to energize the coil of each relay connected to terminal 24. Resistors 110, 112, capacitors 114, 116 and source 118 are similar to resistor 100, 106, capacitors 108, 102 and source 104, respectively.

Referring to FIGS. 1 and 2 the operation of the interface 10 is now described. Assuming terminal 16 is open and the relay switches are OFF then the voltage level of the input signal at point B is high in comparison to the reference voltage at point 46. Thus comparator 48 outputs its first lower voltage level at point C. This low voltage level at point C is less than the reference voltage at point 46 and thus the output voltage level of comparator 50 at point E is its high second level. Because the outputs of the comparators are constant, the multivibrators 72, 82 do not provide any output signals.

Activation of a contact switch (not shown) connects terminal 16 with ground 14. This results in the input signal at point B changing from its high level to its low level. Because the low level is less than the reference voltage to comparator 48, the output of comparator 48 at point C changes from its to first lower level to its second higher level. During this change in level multivibrator 72, which has its trigger input connected to the output of comparator 48, does not sense a negative pulse but senses a positive pulse and as a result does not provide any signals. The output at point C of comparator 48 is greater than the reference voltage to comparator 50 which causes the output voltage of comparator 50 at point E to change from its higher second level to its lower first level. During this change, the trigger input for the multivibrator 82 senses the negative pulse and produces a momentary electrical signal whose duration is substantially predetermined by resistor 86, and capacitor 84. The momentary electrical signal turns triac 92 on permitting current to flow from terminal 24 through triac 92 to ground bus 40. Terminal 24 is connected to one of the coils of the relay switch whereby these coils are energized for as long as triac 90 conducts, i.e.; the duration of the momentary electrical signal. Energization of this coil turns the relay ON (curve A). The significance here is that once terminal 16 is grounded current is only permitted to pass through one of the coils of the relays for a limited time and thus the possibility of thermal damage in the relays is reduced and mechanical binding in the relays due to coil energization is eliminated.

To energize the other coil of the relays, the switch (not shown) associated with terminal 16 opens and terminal 16 is open circuited. This results in the voltage at point B rising causing the output voltage of comparator 48 at point C to drop from its higher second level to its lower first level. The trigger input of multivibrator 72 senses this negative pulse and produces a momentary electrical signal whose duration is substantially determined by resistor 76, and capacitor 74. The momentary electrical signal turns triac 90 ON permitting current to flow from terminal 22 through triac 90 to ground bus 40. This results in the coil of the relays connected to terminal 22 to be energized for as long as triac 90 conducts causing the relays to turn OFF.

Override terminals 18 or 20 may be utilized at any time to energize one of the coils of the relays connected to respective output terminals 24, 22. This is because override terminals 18 and 20 are normally open circuited and are activated by connecting the terminal to ground. Once grounded, the trigger input to the multivibrator becomes grounded. When the trigger input is grounded, a negative excursion on pulse is sensed by the trigger input. This results in the generation of the momentary electrical signal. It is a significant that the interface only provides one momentary electrical signal for as long as the override device is activated.

Figure 3:
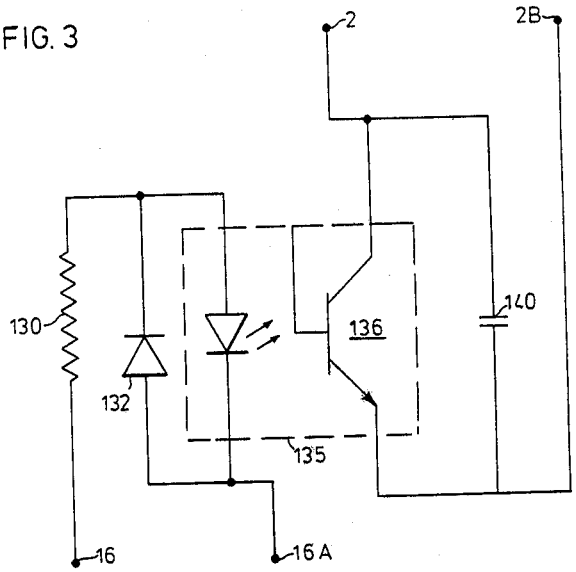
FIG. 3 is a variation that may be utilized in order to interface a computer with the interface apparatus of the present invention.

Referring now to FIG. 3 an adaptation is shown that can be utilized with the interface of FIG. 1 so as to make the interface compatible with a computer which supplies the input signal to the interface. Basically, diode 54 in FIG. 1 would be replaced with the circuit arrangement of FIG. 3. Terminal 2 of FIG. 3 would be connected to point 2A of FIG. 1. Terminal 2B would be connected to the ground bus 40 of FIG. 1. Terminal 16 would be connected to the computer with terminal 16A connected to the computor common or ground. Resistor 130 is chosen to limit the current from the computer value for photo-coupler 135. Diode 132 ensures that positive spikes between terminal 16 and terminal 16A do not affect the photo-coupler 135. Capacitor 140 protects the photo-coupler 135 from any sudden current changes in the interface device. In operation, when transistor 136 of the photo-coupler is not conducting the level of the input signal at point B (FIG. 1) is held high. The computer provides a step signal that causes the transistor 136 to conduct which results in the voltage level of the input signal at point B falling. In effect, the photo-coupler arrangement shown in FIG. 3 converts the input signal from the computer into an input signal compatible with the interface apparatus.

Since numerous changes and modifications can be made in the structure of the present invention without departing from its scope, the claims are to be considered in the light of the full breadth of the invention to which they pertain and not restricted to the specific embodiment disclosed.

What I claim as new and desire to secure by Letters Patent of the United States is:

1. In a remote control switching system having an interface apparatus capable of producing momentary first and second electrical signals to control energization of first and second coils of solenoid actuated relays respectively in response to interruption and initiation of an input signal present at an input for the apparatus, said apparatus comprising:

a first comparing means having a sensing input operably connected to the apparatus input to sense changes in the input signal by comparing the input signal with a first reference voltage value, the first comparing means having a first output whose voltage value changes from its first to its second level when the input signal becomes less than the first reference value and changes from its second to its first level when the input signal becomes greater than the first reference value;

a second comparing means having a sensing input operably connected to the first output to sense changes in the first output voltage value by comparing the first output value with a second reference voltage, the second comparing means having a second output whose voltage value changes from its first to its second level when the first output voltage value changes to its first level becoming less than the second reference value and changes from its second to its first level when the first output voltage value changes to its second level becoming greater than the second reference value;

a first pulse generation means connected to the first output to provide the momentary first electrical signal to the first coils when the first output voltage value changes from its second to its first level; and, a second pulse generation means connected to the second output to provide the momentary second electrical signal to the second coils when the second output voltage value changes from its first to its second level.

2. The system of claim 1 wherein the first and second reference voltage values are equal.

3. The system of claim 1 further including a first override device wherein said first output is connected to said first override device which when actuated causes the first pulse generation means to provide the momentary first electrical signal.

4. The system of claim 1 or 3 and further including a second override device wherein the second output is connected to said second override device which when actuated causes the second pulse generation means to provide the momentary second electrical signal.

5. The system of claim 1 wherein the first and second pulse generation means each comprises a monostable multivibrator having an RC circuit associated therewith that substantially determines the duration of the momentary electrical signals, each monostable multivibrator having its trigger input connected to its corresponding comparing means output.

6. The system of claim 5 wherein each of the comparing means includes a comparator.

7. The system of claim 2 wherein the first level is less than the second level for each of the first and second output voltage values, whereby the level of the second output voltage is the inverse level of the first output voltage value.

8. The system of claim 1 or 6 and further including a photo-coupler wherein said photo-coupler is employed to convert the input signal from a computer into an input signal compatible with the interface apparatus.

9. The system of claim 3 wherein the first override device when activated effectively grounds trigger input for the first pulse generation means.

10. The system of claim 5 wherein each multivibrator is triggered by a negative excursion present on its trigger input.

* * * * *